US006158213A

United States Patent [19]

Linberg et al.

[11] Patent Number: 6,158,213

[45] Date of Patent: Dec. 12, 2000

[54] VEHICLE EXHAUST CHANGEOVER APPARATUS

[76] Inventors: G. Douglas Linberg, 3003 Stuart Way, Lansdale, Pa. 19446; David J. Linberg, 2410 Swede Rd., Norristown, Pa. 19401; Gregory Linberg, 212 Francis Ave., Norristown, Pa. 19401

[21] Appl. No.: 09/382,764

[22] Filed: Aug. 25, 1999

[51] Int. Cl.[7] ..... F01N 5/00

[52] U.S. Cl. ..... 60/281; 60/324

[58] Field of Search ..... 60/281, 324

[56] References Cited

U.S. PATENT DOCUMENTS

| | | | |
|---|---|---|---|
| 2,401,858 | 6/1946 | Clark | 60/281 |
| 2,495,092 | 1/1950 | Cox et al. | 60/281 |
| 2,910,827 | 11/1959 | Walter | 60/281 |
| 3,610,360 | 10/1971 | Gardner | 180/64 |
| 4,061,215 | 12/1977 | Ishikawa | 192/4 A |
| 4,186,703 | 2/1980 | Haka et al. | 123/119 A |
| 4,253,336 | 3/1981 | Pietzuch | 73/422 R |
| 5,398,503 | 3/1995 | Danno et al. | 60/288 |
| 5,452,578 | 9/1995 | Barber | 60/324 |
| 5,634,333 | 6/1997 | Tanaka et al. | 60/287 |
| 6,014,858 | 1/2000 | Zankowski | 60/324 |
| 6,029,444 | 2/2000 | Nakamura et al. | 60/324 |

FOREIGN PATENT DOCUMENTS

| | | | |
|---|---|---|---|
| 3432195 | 3/1986 | Germany | 60/324 |
| 3433569 | 3/1986 | Germany | 60/324 |

*Primary Examiner*—Thomas Denion
*Assistant Examiner*—Diem Tran
*Attorney, Agent, or Firm*—Martin Fruitman

[57] ABSTRACT

The apparatus is an automatic changeover system for a vehicle exhaust ventilating pipe. The exhaust pipe on a vehicle is fed into a valve which changes its output to either the conventional vehicle mounted exhaust outlet pipe or a bypass pipe low on the chassis to which a ventilating hose can easily be attached. The activating arm of an electrical switch is located at the end of the bypass pipe where it is held down by the ventilating hose when the hose is installed. Thus, when the vehicle is moved and the ventilating hose pulled off, the switch arm is released, and the switch activates a powered activator which moves the valve to close the bypass and open the output to the exhaust outlet pipe for normal operation.

8 Claims, 1 Drawing Sheet

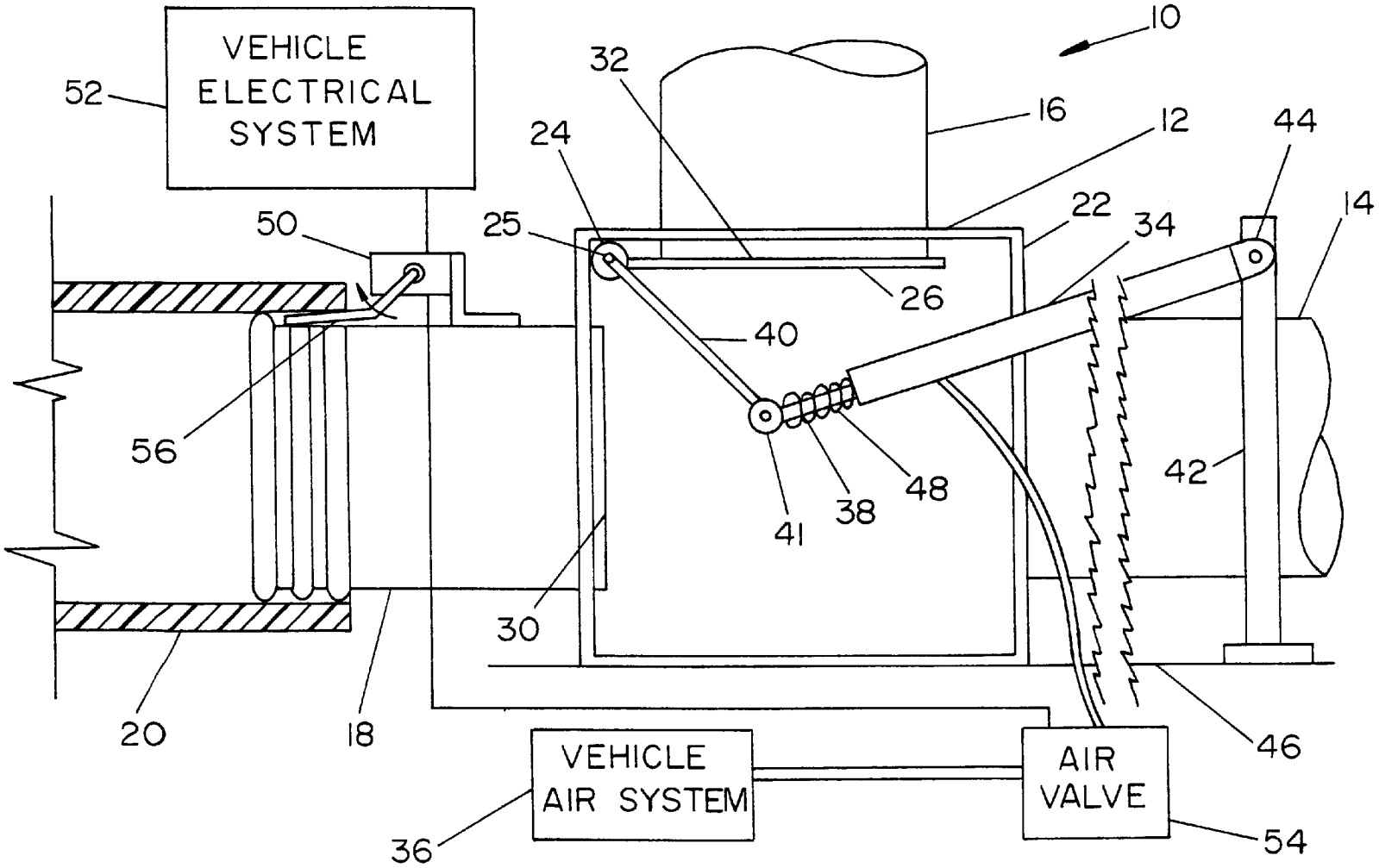
10
12
14
16
18
20
22
24
25
26
30
32
34
36
38
40
41
42
44
46
48
50
52
54
56
AIR VALVE
VEHICLE AIR SYSTEM
VEHICLE ELECTRICAL SYSTEM

VEHICLE EXHAUST CHANGEOVER APPARATUS

BACKGROUND OF THE INVENTION

This invention deals generally with the collection and discharge of exhaust gases from motor vehicles operating within a building, and more specifically with an exhaust control system installed aboard a vehicle which automatically switches over from the building exhaust system to the normal vehicle exhaust system when the vehicle is moved from the building.

The requirement that motor vehicle exhaust gases be removed from any enclosure within which a vehicle is operating is quite obvious since the carbon monoxide emitted from a vehicle exhaust is toxic. The existing devices to accomplish the direct discharge of such vehicle exhaust gases to the outside of the building are quite varied. They include everything from a simple flexible hose slipped over the tail pipe and through a hole in a garage door to multiple stations with blower driven exhaust ducts to which flexible hoses are attached for connection to the vehicles' exhaust pipes.

These vehicle exhaust systems for buildings all have one thing in common. They are all attached to the vehicles with flexible hoses which must be attached when the vehicles are put into the building and detached when the vehicles are moved.

Many exhaust systems allow the hose to be moved along the length of a permanent exhaust duct even when connected to a vehicle's exhaust. In such systems a vehicle's emissions can be discharged outside even while the vehicle moves through the building, and they also permit the connection of hoses to vehicles of various sizes or in multiple locations. This movement of the hoses along an exhaust duct is generally accomplished by means of a duct which has a flexible seal to close a slot through which a pipe of a hose trolley extends into the duct. There are exhaust ducts with trolleys which are located overhead in buildings, and there are those built into the floor of a building which use trolleys rolling on the floor.

Experience has shown that the overhead exhaust trolleys require larger blowers for the use by vehicles with exhaust systems at the bottom of the vehicle because they require long hoses which increase the load on the exhaust system. Furthermore, manually attaching a flexible hose to the end of an exhaust outlet pipe located at the top of a vehicle can be time consuming, difficult, and even dangerous.

On the other hand, while exhaust trolleys at ground level are particularly convenient to use for vehicles with exhaust pipes located at the bottom of the vehicle, they have the same difficulty in attachment to exhaust pipes which are located at the top of a vehicle.

It would be very beneficial to have a device which would permit attaching a flexible hose to a vehicle exhaust system approximately at ground level even for a vehicle whose exhaust discharged near the top of the vehicle.

SUMMARY OF THE INVENTION

The present invention is an apparatus which permits a flexible ventilating hose to be attached to or removed from the exhaust system of a vehicle which has an exhaust outlet pipe discharging high above ground level while the person attaching or detaching the hose remains standing on the ground.

The apparatus is an automatic changeover system for a vehicle exhaust pipe. The exhaust gas of a vehicle is fed into a changeover valve which directs its output to either the conventional vehicle mounted exhaust outlet pipe or to a bypass pipe located low on the vehicle to which a ventilating hose can be attached. The preferred embodiment of the invention is a pneumatically operated changeover valve which closes one or the other of its two valve outlets, thus permitting the exhaust to exit through the other outlet. The valve has a swinging flap acting to alternately close off the outlet pipes, and it is spring loaded to normally open the ventilation bypass pipe, but when the vehicle is operating and the ventilating hose is removed, the vehicle exhaust system operates in its conventional manner with the gas flowing through the exhaust outlet pipe.

An electrical switch is located at the end of the bypass pipe where the electrical switch activating arm is held down by the ventilating hose when the hose is installed on the bypass pipe. When the vehicle is parked inside and the ventilating hose is installed on the bypass pipe, the electrical switch is open and does not operate an air valve which opens an air line from the vehicle air system to activate a pneumatic piston that moves an arm to overcome the spring force on the changeover valve. Without power or air pressure the changeover valve is thus set with the outlet to the bypass pipe open and the outlet to the vehicle's normal exhaust outlet pipe closed.

When the vehicle is started, air pressure builds up, and the ventilating hose is pulled off, either manually or because the vehicle is moved, the electrical switch activating arm is released, the switch turns on electrical power to the air valve, and the air supply is connected to the pneumatic piston. The changeover valve then moves the swinging flap to close the outlet to the bypass pipe and open the outlet to the vehicle's vertical pipe for normal operation.

With the open end of the bypass pipe and the ventilating hose connection located where they are accessible to someone on the ground, the present invention affords a quick and safe means to attach a ventilating hose to a vehicle with a exhaust outlet pipe, or to remove it from the vehicle, without climbing atop the vehicle or using a ladder. Furthermore, once installed on a vehicle, the invention can be used with ventilating hoses of either overhead or ground level type ventilating systems.

BRIEF DESCRIPTION OF THE DRAWINGS

The FIGURE is a simplified schematic view of the vehicle exhaust control apparatus of the preferred embodiment of the invention, shown with part of the ventilating hose in cross section, with the near side of the changeover valve removed for viewing the operating mechanism, and with the pneumatic piston not shown for its full length.

DETAILED DESCRIPTION OF THE INVENTION

The FIGURE is a simplified schematic view of vehicle exhaust control apparatus 10 of the preferred embodiment, which includes changeover valve 12, exhaust inlet pipe 14, exhaust outlet pipe 16, and ventilating bypass pipe 18. In the FIGURE, ventilating hose 20 is shown in cross section, the near side of changeover valve 12 is removed for viewing the internal mechanism, and pneumatic piston 34 is shown without a portion of its length.

If exhaust control apparatus 10 were not installed, exhaust inlet pipe 14, which is typically under the chassis of the vehicle, would be directly connected to exhaust outlet pipe 16. Exhaust outlet pipe 16 is the pipe which is commonly seen rising to the top of the vehicle and is located directly behind the cabs of trucks, buses, and emergency vehicles. Enclosure 22 of changeover valve 12 can merely substitute for the pipe elbow which would normally be located between exhaust inlet pipe 14 and exhaust outlet pipe 16.

Changeover valve 12 operates in a simple manner by rotating pivot 24 to which swinging flap 26 is attached. Depending upon the rotational position of pivot 24, flap 26 closes off end 30 of bypass pipe 18, or, as shown in the FIGURE, it closes off end 32 of exhaust outlet pipe 16. Since flap 26 is attached to pivot 24, as can be seen by the simplified view of the FIGURE, it is not possible for both bypass pipe 18 and exhaust outlet pipe 16 to be closed off at the same time.

Pivot 24 is operated by conventional pneumatic piston 34, which is quite convenient because in most circumstances vehicles already have pressurized air system 36 available aboard. Rod 38 of pneumatic piston 34 is attached to operating arm 40 at pivot point 41, and therefore rotates pivot 24 as rod 38 is extended or retracted by pneumatic piston 34. Pneumatic piston 34 is installed in the typical manner for such devices by being attached to anchor post 42 at pivot point 44. Anchor post 42 is, in turn, connected to a chassis member 46. Since the attachment of pneumatic piston 34 at both its ends is at pivot points, pneumatic piston 34 can follow the arc of the movement of pivot point 41.

It should be understood that pneumatic piston 34 and operating arm 40 are located outside changeover valve 12, and that arm 40 is connected to pivot 24 by an extension of axis 25 of pivot 24.

It is desirable to assure that bypass pipe 18 is always open when exhaust control apparatus 10 is not operating so that when the vehicle is started within a building the exhaust will be properly ventilated, even if the pressure in the vehicle air system has bled off. This is accomplished by spring 48. Spring 48 is shown around rod 38, but that location is not vital. Pneumatic pistons can also include internal springs so that the piston will always be retracted when air pressure is not applied to it. For that matter, it is also possible to use an external spring to assure that bypass pipe 18 is open if exhaust control apparatus 10 is not operating. As can be appreciated from the FIGURE, spring 48 assures that bypass pipe 18 is open and exhaust outlet pipe 16 is closed unless pneumatic piston 34 is operated to extend rod 38.

Electrical switch 50 provides the feature of the invention which closes off bypass pipe 18 when ventilating hose 20 is not attached to bypass pipe 18. Electrical switch 50 is connected to vehicle electrical system 52 and to electrically operated air valve 54 which is connected to vehicle air system 36. Air valve 54 is connected to and activates pneumatic piston 34. Thus, as long as electrical switch 50 is open, no electrical power is fed to air valve 54, spring 48 prevents rod 38 from being extended, and bypass pipe 18 remains open.

Switch 50 acts as a sensor to determine when ventilating hose 20 is mounted on bypass pipe 18, and arm 56 is the operating mechanism for switch 50. Switch 50 is a conventional electrical limit switch whose status is changed by the rotation of arm 56, and arm 56 is spring loaded to rotate in the direction indicated by the arrow shown at the switch when it is not otherwise moved or restricted. Therefore, when ventilating hose 20 is not installed over bypass pipe 18, arm 56 rotates in the direction of the arrow and switch 50 is closed. That is, switch 50 is designated as "normally on". However, when ventilating hose 20 is installed on bypass pipe 18, ventilating hose 20 forces arm 56 to rotate in the direction opposite from that indicated by the arrow, and switch 50 opens to cut off electrical power to air valve 54 and keep changeover valve 12 in position to open bypass pipe 18 and close exhaust outlet pipe 16.

However, when ventilating hose 20 is removed from bypass pipe 18, switch 50 is no longer held down, and it returns to its "on" condition. Then, if there is air pressure in vehicle air system 36 as when the vehicle is operating, air valve 54 is operated and furnishes air to pneumatic piston 34 which extends rod 38 and swings flap 26 to open exhaust outlet pipe 16 and close bypass pipe 18. Under these conditions of the vehicle operating and ventilating hose 20 removed from bypass pipe 18, the vehicle exhaust is operating is its normal fashion with the exhaust exiting through its on board exhaust system.

Changeover valve 12 is shown and has been described in a very simple but quite functional form, although it can be constructed in many configurations. For example, individually operated pneumatic, hydraulic, or electrical valves can be installed anywhere along exhaust outlet pipe 16 and bypass pipe 18, and such valves can be individually controlled by electrical logic circuitry so that a sensor on bypass pipe 18 still determines that bypass pipe 18 will be open and exhaust outlet pipe 16 will be closed when ventilating hose 20 is attached to bypass pipe 18.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, enclosure 12 could be a mere junction between exhaust inlet pipe 14, exhaust outlet pipe 16, and bypass pipe 18, and any conventional sensor could be substituted for arm 56 of switch 50 to determine that ventilating hose 20 is attached to bypass pipe 18. Furthermore, various other control devices such as electrical or hydraulic operators could be used to activate valve means in the pipes to divert the flow of exhaust gas into or out of bypass pipe 18 and exhaust outlet pipe 16.

What is claimed as new and for which Letters Patent of the United States are desired to be secured is:

1. A vehicle exhaust changeover apparatus to switch a vehicle exhaust from a normal exhaust outlet pipe to a bypass pipe to which is attached a ventilating hose, comprising:

a junction between an exhaust inlet pipe, an exhaust outlet pipe, and a bypass pipe;

valve means operating to direct gas from the exhaust inlet pipe into one of either the exhaust outlet pipe or the bypass pipe;

a sensing means to determine when a ventilating hose is attached to the bypass pipe; and control means interconnected with the sensing means and the valve means and controlling the valve means to direct gas from the exhaust inlet pipe into the bypass pipe when the ventilating hose is attached to the bypass pipe.

2. The apparatus of claim 1 wherein the junction and the valve means are located within a common enclosure.

3. The apparatus of claim 1 wherein the valve means is a valve with a structure to close the bypass pipe or the exhaust outlet pipe, and the structure is oriented so that only one of the pipes is closed at any time.

4. The apparatus of claim 1 wherein the valve means is a valve with a swinging flap to close the bypass pipe or the exhaust outlet pipe, and the flap is oriented so that only one of the pipes is closed at any time.

5. The apparatus of claim 1 wherein the sensing means is an electrical switch attached to the bypass pipe, and the electrical switch has an activating arm which the ventilating hose contacts when the ventilating hose is installed on the bypass pipe.

6. The apparatus of claim 1 wherein the control means is an air valve attached to a vehicle air system and the air valve is connected to and operates at least one pneumatic piston which is attached to and operates the valve means.

7. The apparatus of claim 1 further including a spring interconnected with the valve means, with the spring positioning the valve so that the bypass pipe is open when the ventilating hose is attached to the bypass pipe.

8. The apparatus of claim 1 further including a spring interconnected with the valve means, with the spring positioning the valve so that the bypass pipe is open when no electrical power is supplied to the exhaust changeover apparatus.

* * * * *